US009181675B2

(12) United States Patent
Ueki et al.

(10) Patent No.: US 9,181,675 B2
(45) Date of Patent: Nov. 10, 2015

(54) CONSTRUCTION MACHINE

(75) Inventors: Tsuyoshi Ueki, Omitama (JP); Yukihiro Tatsuno, Tsukuba (JP); Hidefumi Hiramatsu, Hitachinaka (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 115 days.

(21) Appl. No.: 14/000,626

(22) PCT Filed: Apr. 25, 2012

(86) PCT No.: PCT/JP2012/061102

§ 371 (c)(1),
(2), (4) Date: Aug. 21, 2013

(87) PCT Pub. No.: WO2012/153638

PCT Pub. Date: Nov. 15, 2012

(65) Prior Publication Data

US 2013/0323001 A1 Dec. 5, 2013

(30) Foreign Application Priority Data

May 12, 2011 (JP) ..... 2011-107149

(51) Int. Cl.

| | |
|---|---|
| ***E02F 3/38*** | (2006.01) |
| ***E02F 3/32*** | (2006.01) |
| ***E02F 3/30*** | (2006.01) |
| ***E02F 9/08*** | (2006.01) |
| ***E02F 9/22*** | (2006.01) |
| ***E02F 3/42*** | (2006.01) |

(52) U.S. Cl.

CPC . *E02F 3/32* (2013.01); *E02F 3/301* (2013.01); *E02F 3/38* (2013.01); *E02F 3/425* (2013.01); *E02F 9/0858* (2013.01); *E02F 9/0891* (2013.01); *E02F 9/2271* (2013.01)

(58) Field of Classification Search

CPC ..... E02F 3/28; E02F 3/32; E02F 3/38; E02F 3/301; E02F 9/16; E02F 9/22; E02F 9/0858

USPC ..... 414/722

See application file for complete search history.

(56) References Cited

U.S. PATENT DOCUMENTS

| | | | | |
|---|---|---|---|---|
| 3,589,539 | A * | 6/1971 | Witwer | 414/694 |
| 5,975,833 | A * | 11/1999 | Yamada et al. | 414/687 |
| D437,602 | S * | 2/2001 | Hiraoka et al. | D15/25 |

FOREIGN PATENT DOCUMENTS

| | | |
|---|---|---|
| JP | 2002-061223 A | 2/2002 |
| JP | 2006-193913 A | 7/2006 |

* cited by examiner

*Primary Examiner* — Saul Rodriguez
*Assistant Examiner* — Ronald Jarrett
(74) *Attorney, Agent, or Firm* — Mattingly & Malur, PC

(57) ABSTRACT

A working mechanism (4) takes a traveling stance by a way that left and right boom cylinders (9, 10) are expanded to rotate a tip end of a first boom (5) to the rear side and a positioning cylinder (11) is compressed to rotate a tip end of a second boom (6) to the lower side. In the traveling stance of the working mechanism (4), a front surface plate (23A) of a right front housing cover (23) is inclined along a tilting angle (α) of the left and right boom cylinders (9, 10), and the front surface plate (23A) of the right front housing cover (23) is arranged in a position of lining with front ends (9A1, 10A1) of tubes (9A, 10A) in the left-right direction forming the respective boom cylinders (9, 10).

4 Claims, 6 Drawing Sheets

CONSTRUCTION MACHINE

TECHNICAL FIELD

The present invention relates to a construction machine of a hydraulic excavator provided with a working mechanism including a two-piece boom comprising a first boom and a second boom or the like.

BACKGROUND ART

In general, a hydraulic excavator known as a representative example of a construction machine is configured of an automotive lower traveling structure, an upper revolving structure that is rotatably mounted on the lower traveling structure, and a working mechanism that is tiltably provided in an intermediate position in the left-right direction at a front side of the upper revolving structure. The upper revolving structure is configured of a revolving frame forming a support structure, a cab that is provided in a left front side of the revolving frame and is provided with an operator's seat on which an operator is seated, a right front housing cover that is positioned in a right front side at the opposite side in the left-right direction to the cab and is provided on the revolving frame to accommodate articles therein, an engine that is mounted in a rear side of the revolving frame, and a rear housing cover that covers the engine.

The working mechanism is configured of a boom a base end of which is tiltably connected to the revolving frame of the upper revolving structure, an arm that is rotatably connected to a tip end of the boom, a bucket that is rotatably connected to a tip end of the arm, and a boom cylinder, an arm cylinder and a bucket cylinder that respectively operate the boom, the arm and the bucket.

On the other hand, some of the working mechanisms adopt a two-piece boom in which the boom is divided into two pieces made of a first boom and a second boom for expanding a movable range thereof. The two-piece boom is configured of a first boom a base end of which is rotatably connected to the revolving frame, a second boom that is rotatably connected to a tip end of the first boom, a boom cylinder that is provided between the revolving frame and the tip end of the first boom to be positioned ahead of the base end of the first boom for lifting and tilting the first boom to the revolving frame, and a positioning cylinder that is provided between the first boom and the second boom to be positioned in front of the first boom for adjusting a folding angle of the second boom to the first boom, wherein the arm is rotatably connected to the tip end of the second boom.

The working mechanism with a two-piece boom specification rotates the second boom to the first boom by the positioning cylinder, thus making it possible to adjust the folding angle of the second boom to the first boom as needed. In a case where the excavating operation is performed by using the working mechanism, the movable range of the working mechanism can be widened by adjusting the folding angle between the first boom and the second boom corresponding to the excavating depth.

Further, some of the hydraulic excavators are provided with a wheel type lower traveling structure in such a manner as to be able to travel on a public road. At the traveling of the hydraulic excavator, the working mechanism takes a traveling stance where the boom cylinder is expanded to rotate the tip end of the first boom to the rear side and the positioning cylinder is compressed to rotate the tip end of the second boom to the lower side. At the time of putting the working mechanism to the traveling stance thus, the entire working mechanism can be folded in a compact manner to facilitate a driving operation of the working mechanism. On the other hand, a range of vision in the right side of an operator who drives the hydraulic excavator in the cab is widened by arranging the tip end of the first boom to be in the rear side (for example, Patent Document 1).

PRIOR ART DOCUMENT

Patent Document

Patent Document 1: Japanese Patent Laid-Open No. 2002-61223 A

SUMMARY OF INVENTION

In Patent Document 1 as described above, a range of vision in the right side of the operator is widened by arranging the tip end of the first boom to be in the rear side. However, in Patent Document 1, the right front housing cover used as an accommodation box of tools is arranged to project largely ahead of the boom cylinder. Therefore when the operator looks at the right side from the cab, the right front housing cover is an obstacle to the view of the operator, causing a problem that the range of vision in the right side of the operator is narrowed.

In this case, it can be considered to widen the range of vision in the right side of the operator by backing the right front housing cover to the rear side. However, in a case of backing the right front housing cover to the rear side, there occurs a problem that an accommodation space for tools within the right front housing cover is made small. Further, since the installation space on the revolving frame is narrowed, there occurs a problem that the installation of an oil reservoir tank, a heat exchanger and the like is restricted.

In view of the above-discussed problems with the conventional art, it is an object of the present invention to provide a construction machine that can improve operability thereof at traveling by arranging a right front housing cover to be in a position of not narrowing a range of vision of an operator while ensuring an accommodation space within the right front housing cover.

(1) A construction machine according to the present invention comprises an automotive vehicle body, a working mechanism that is tiltably provided in an intermediate position in the left-right direction at a front side of the vehicle body, a cab that is provided in a front portion of the vehicle body to be positioned in a left side of the working mechanism and is provided with an operator's seat for an operator to be seated on, and a right front housing cover that is provided in the front portion of the vehicle body to be positioned in a right side of the working mechanism for accommodating articles therein, the working mechanism comprising a first boom whose base end is rotatably connected to the vehicle body, a second boom that is rotatably connected to a tip end of the first boom, a boom cylinder of which one end in a length direction is connected to a cylinder mounting portion of the vehicle body in a position ahead of the base end of the first boom and the other end in the length direction is connected to a side of the tip end of the first boom to tilt the first boom to the vehicle body, and a positioning cylinder that is provided between the first boom and the second boom to be positioned in a front surface side of the first boom for adjusting a folding angle of the second boom to the first boom, wherein the working mechanism is configured to take a traveling stance by a way that the boom cylinder is expanded to rotate the tip end of the first boom to the rear side and the positioning cylinder is compressed to rotate a tip end of the second boom to the lower side.

For solving the aforementioned problems, the configuration adopted by the present invention is characterized in that in the traveling stance of the working mechanism, the boom cylinder is arranged to be inclined in such a manner that the other end in the length direction is positioned in back of the one end in the length direction, a front surface plate of the right front housing cover is formed to be inclined along a tilting angle of the boom cylinder, and the front surface plate of the right front housing cover is arranged in a position of lining with a front end of the boom cylinder in the left-right direction.

With this arrangement, by arranging the front surface plate of the right front housing cover to be in the position of lining with the front end of the boom cylinder in the left-right direction at the time the working mechanism takes a traveling stance, when the operator seated on the operator's seat in the cab looks at the right side, the right front housing cover is in a state of being hidden with the boom cylinder. Therefore, the operator can travel the construction machine in a wide range of vision without interruption of the range of vision by the right front housing cover. In addition, in a case of confirming the right side at traveling, some of operators perform a confirmation operation of the right side by moving the head to the front side. Even when this confirmation operation is performed, since the right front housing cover is arranged to line with the front end of the boom cylinder in the left-right direction, the right front housing cover can be positioned outside of a range of vision in the right side of the operator.

On the other hand, since the right front housing cover is configured in such a manner as to be able to arrange the front surface plate in the front side to be in the position of lining with the front end of the boom cylinder in the left-right direction, the right front housing cover can be formed in the front side to increase the installation space on the vehicle body including the right front housing cover.

As a result, when the operator boards on the cab and performs the traveling operation while ensuring the installation space on the vehicle body including the right front housing cover, the range of vision in the right side can be widened and the operability and the safety at traveling can be improved. Further, since the right front housing cover can largely be formed, various instruments can be easily incorporated on the vehicle body to improve the assembling operability and the like.

(2) According to the present invention, the front surface plate of the right front housing cover is arranged at the same tilting angle ($\alpha$) with that of the front end of the boom cylinder in the traveling stance. It should be noted that the same tilting angle does not mean the same angle literally, but also in a case where there is a slightly angular difference within an allowance range on a design between the tilting angle of the front surface plate of the right front housing cover and the tilting angle of the front end of the boom cylinder, each tilting angle of both can be admitted as the same tilting angle.

With this arrangement, when the operator looks at the right side, the operator can travel the construction machine in a wide range of vision without interruption of the range of vision by the right front housing cover. On the other hand, since the front surface plate of the right front housing cover can be arranged in a position of lining with the front end of the boom cylinder, the right front housing cover can be extended in the front side to the limit range of vision.

(3) According to the present invention, in the traveling stance where the boom cylinder is expanded to incline the first boom to the rear side at a tilting angle, and the positioning cylinder is compressed to rotate the tip end of the second boom to the lower side, when a plane extending in the left-right direction along the front end of the boom cylinder is formed as an inclined plane, the front surface plate of the right front housing cover is formed to be flush with the inclined plane. As a result, the range of vision of the operator in the right side at the traveling can be widened.

(4) According to the present invention, the vehicle body is provided with a rear housing cover for covering a prime mover mounted in the rear side, and the right front housing cover is formed in the same height dimension with the rear housing cover.

With this arrangement, since the height dimension of the right front housing cover is formed to have the same height dimension with the rear housing cover for covering the large prime mover, the accommodation space within the right front housing cover can largely be formed to accommodate a large device and many tools.

MODE FOR CARRYING OUT THE INVENTION

Hereinafter, a construction machine according to an embodiment in the present invention will be in detail explained with reference to FIG. 1 to FIG. 6, by taking a wheel type hydraulic excavator provided with a working mechanism comprising a two-piece boom and the like as an example.

Figure 1:
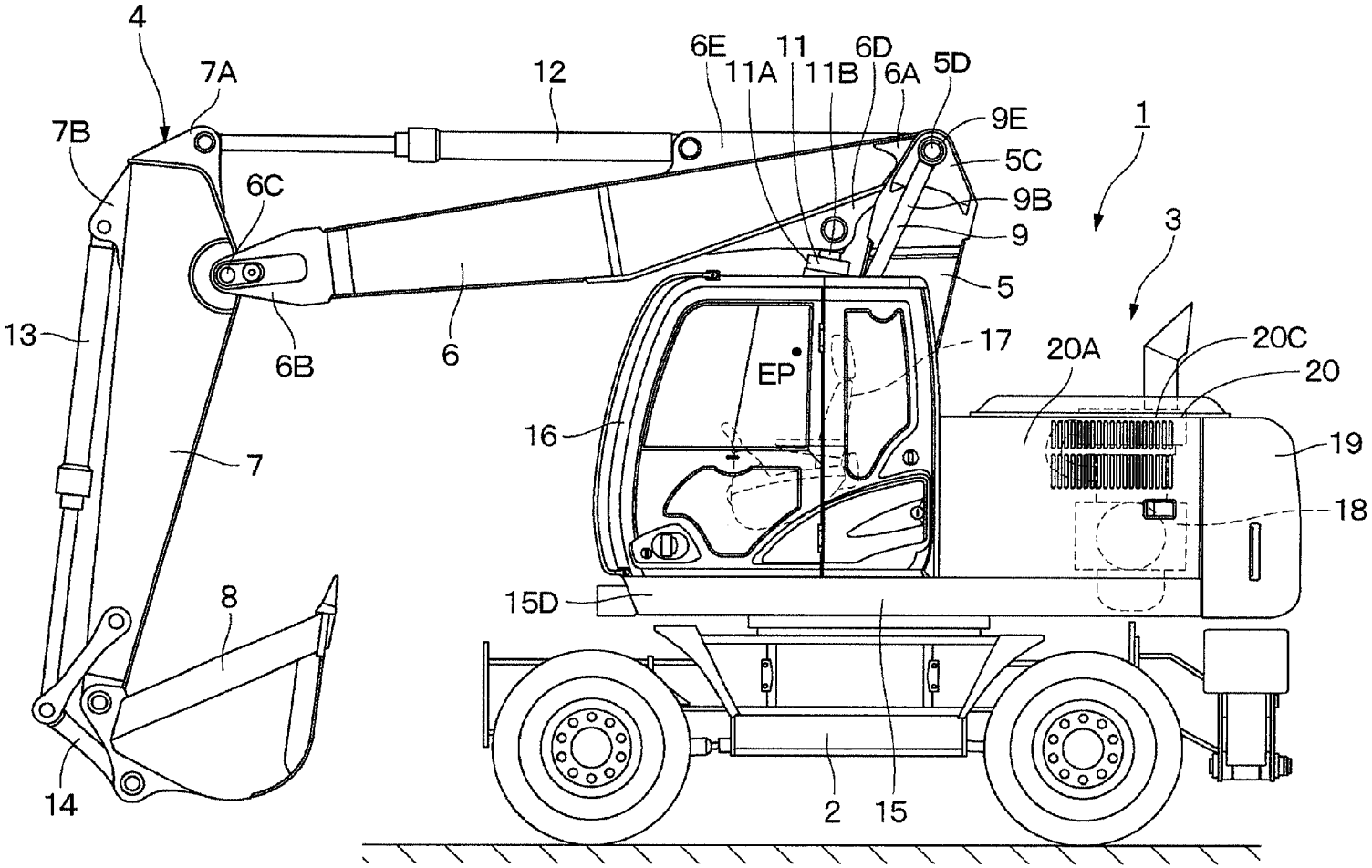
FIG. 1 is a front view showing a hydraulic excavator that is applied to an embodiment in the present invention.

In FIG. 1, designated at 1 is a wheel type hydraulic excavator known as a construction machine. The hydraulic excavator 1 is configured of an automotive lower traveling structure 2, an upper revolving structure 3 rotatably mounted on the lower traveling structure 2, and a working mechanism 4 tiltably provided in an intermediate position in the left-right direction at a front side of the upper revolving structure 3 for performing an excavating operation of earth and sand, and the like. The wheel type hydraulic excavator 1 travels on a public road by the wheel type lower traveling structure 2 and serves to perform an excavating operation of earth and sand by using the working mechanism 4 at a working site or the like.

Here, the working mechanism 4 is configured of a first boom 5, a second boom 6, an arm 7, a bucket 8, boom cylinders 9 and 10, a positioning cylinder 11, an arm cylinder 12, a bucket cylinder 13, which will be described later, and the like.

The first boom 5 forms a two-piece boom of the working mechanism 4 together with the second boom 6 to be described later. The first boom 5 is rotatably mounted between left and right vertical plates 15B and 15C of a revolving frame 15, that is, in an intermediate position of the revolving frame 15 in the left-right direction. Here, the first boom 5 is formed in an angular cylinder shape in transverse section, and the base end forms a foot portion 5A to be rotatably connected to first boom mounting portions 15B1 and 15C1 of the left and right vertical plates 15B and 15C by a connecting pin 5B. On the other hand, a tip end of the first boom 5 extending upward forms a dichotomous tip end mounting portion 5C, and a base end of the second boom 6 and rod-side mounting portions 9E and 10E of the boom cylinders 9 and 10 to be described later are coaxially and rotatably connected to the tip end mounting portion 5C by a connecting pin 5D. A cylinder bracket 5E is mounted to a front surface of the first boom 5 to be positioned at a side of the foot portion 5A (base end). A tube 11A of the positioning cylinder 11 to be described later is mounted to the cylinder bracket 5E.

The second boom 6 is rotatably mounted to the tip end of the first boom 5, and the second boom 6 rotates in an upper-lower direction to the first boom 5 by expansion/compression of the positioning cylinder 11. Here, the second boom 6 is formed as an angular cylinder body in a square section, and a base end 6A is rotatably connected to the tip end mounting portion 5C of the first boom 5 by the connecting pin 5D. On the other hand, a tip end of the second boom 6 forms a dichotomous mounting portion 6B, and a base end of the arm 7 is rotatably connected to the mounting portion 6B by a connecting pin 6C.

A cylinder bracket 6D to which a rod 11B of the positioning cylinder 11 to be described later is mounted is provided on a bottom surface of the base end 6A of the second boom 6. Further, a cylinder bracket 6E to which a tube of the arm cylinder 12 to be described later is mounted is provided on a top surface of the base end 6A.

Figure 2:
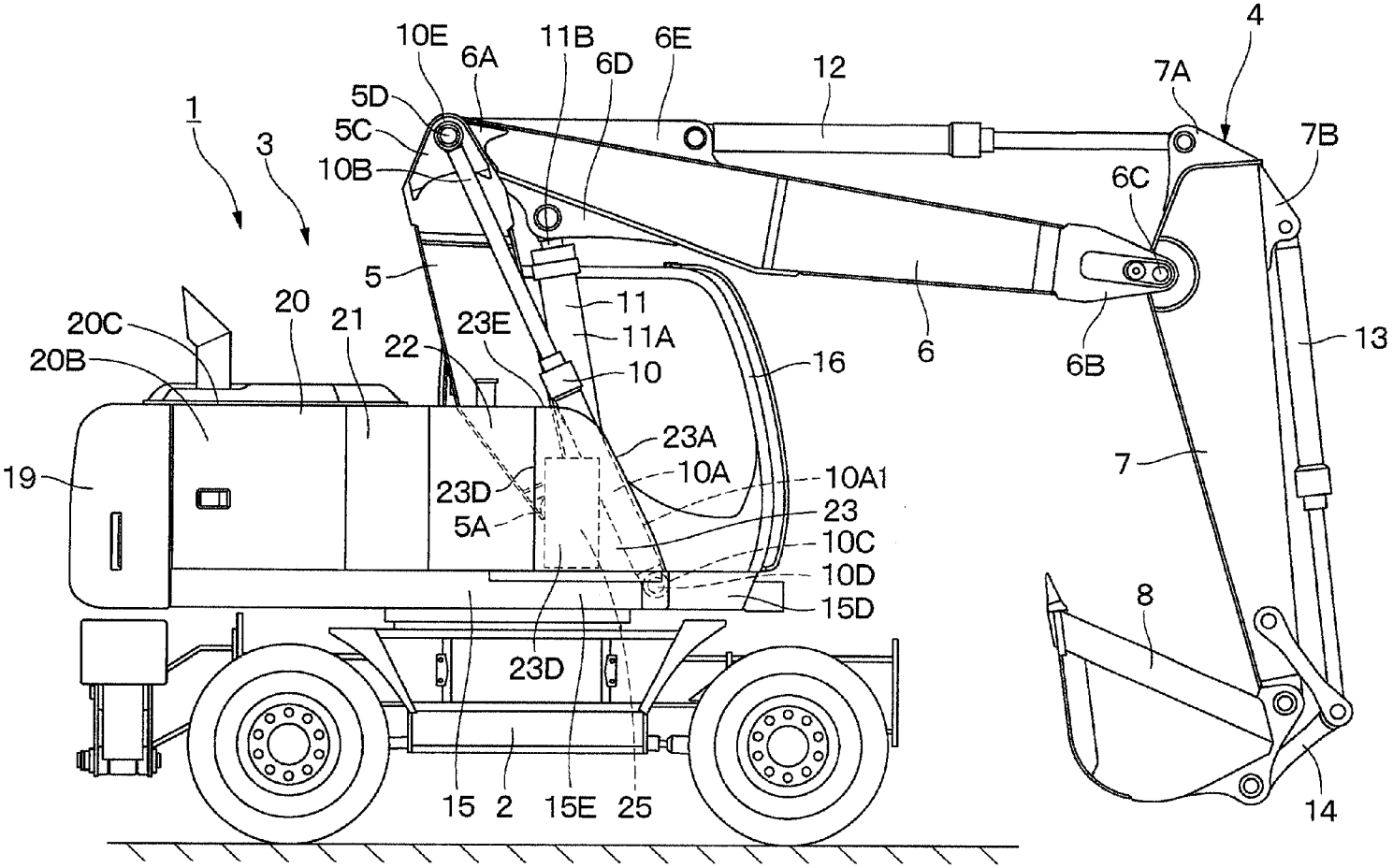
FIG. 2 is a back view showing the hydraulic excavator shown in FIG. 1.

As shown in FIG. 1 and in FIG. 2, the arm 7 is rotatably mounted to the tip end of the second boom 6, and the arm 7 is formed as an angular cylinder body in a square section. The base end of the arm 7 is rotatably connected to the mounting portion 6B of the second boom 6 by the connecting pin 6C, and the bucket 8 to be described later is rotatably mounted to the tip end of the arm 7. On the other hand, a cylinder bracket 7A to which a rod of the arm cylinder 12 is mounted, and a cylinder bracket 7B to which a tube of the bucket cylinder 13 is mounted are provided in the base end of the arm 7.

The bucket 8 is rotatably mounted to the tip end of the arm 7. The bucket 8 is a representative example of a working tool, and rotates by a telescopic operation of the bucket cylinder 13 to perform an excavating operation of earth and sand, and the like.

Next, the left boom cylinder 9, the right boom cylinder 10 and the positioning cylinder 11 that are used in the present embodiment will be described.

The left boom cylinder 9 is mounted on the left side of the first boom 5 to be positioned in the front side of the first boom 5. The left boom cylinder 9 lifts and tilts the first boom 5 to the revolving frame 15 in cooperation with the right boom cylinder 10 to be described later, and is provided between the revolving frame 15 and the tip end of the first boom 5. Here, the left boom cylinder 9 is configured of a cylindrical tube 9A, a piston (not shown) slidably provided in the tube 9A, and a rod 9B a base end side of which is connected to the piston and a tip end side of which telescopically projects from the tube 9A.

Figure 3:
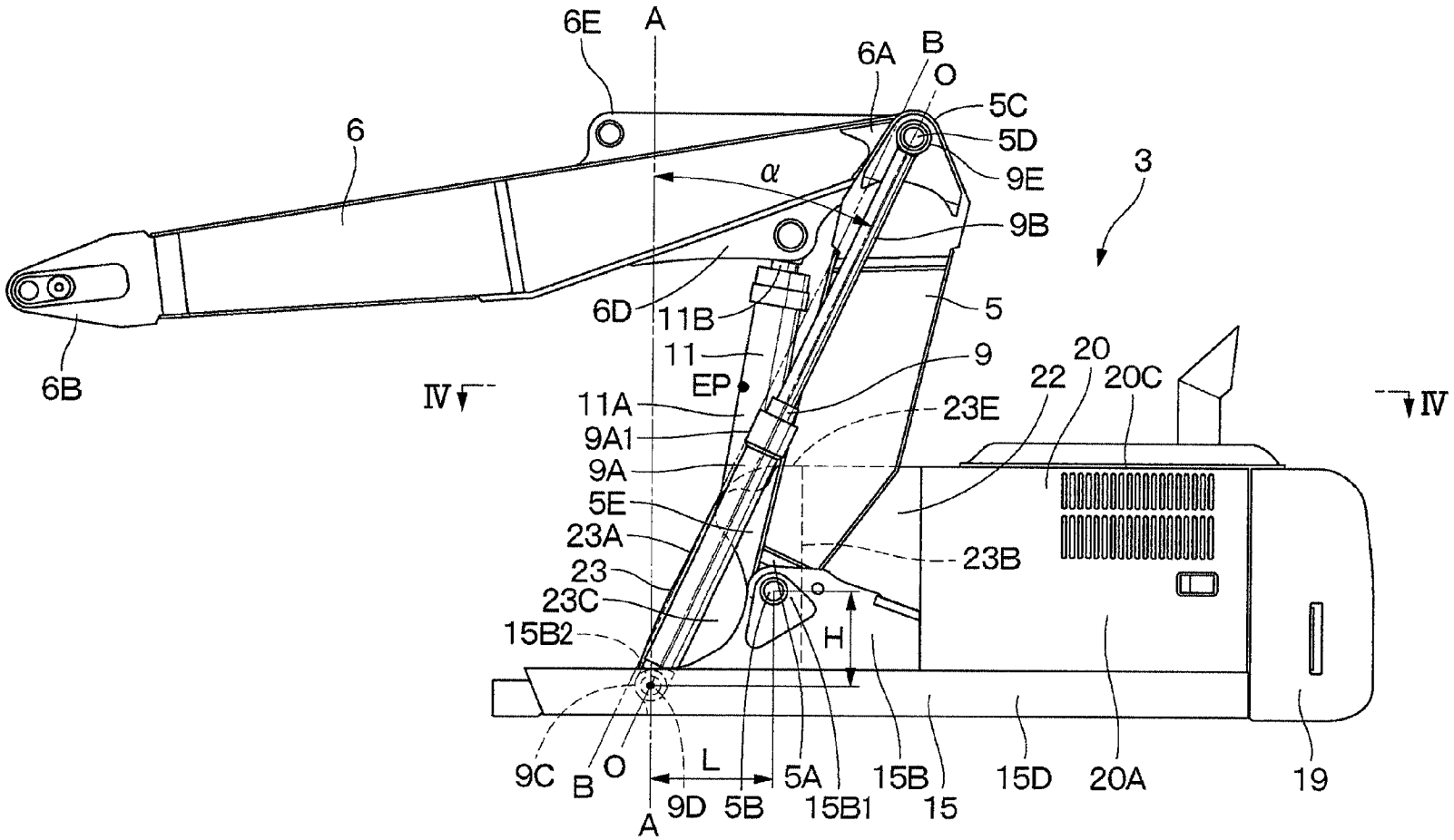
FIG. 3 is a front view shown by enlarging an upper revolving structure and a boom of a working mechanism in a state where a cab is removed.

The left boom cylinder 9 has a bottom portion of the tube 9A, which forms one end in the length direction, forming a bottom-side mounting portion 9C, and the bottom-side mounting portion 9C is rotatably mounted to a cylinder mounting portion 15B2 of a left vertical plate 15B in the revolving frame 15 by using a connecting pin 9D. Therefore as shown in FIG. 3 and in FIG. 5, the bottom-side mounting portion 9C (connecting pin 9D) of the left boom cylinder 9 is arranged in a position lower by a height dimension H than the first boom mounting portion 15B1 of the left vertical plate 15B to which the foot portion 5A of the first boom 5 is mounted by using the connecting pin 5B, and in a position ahead thereof by a length dimension L. On the other hand, the left boom cylinder 9 has a tip end of the rod 9B, which forms the other end in the length direction, forming a rod-side mounting portion 9E, and the rod-side mounting portion 9E is mounted to the tip end mounting portion 5C of the first boom 5 positioned in the tip end side of the first boom 5 by the connecting pin 5D to be coaxial with and rotatable to the base end 6A of the second boom 6.

The right boom cylinder 10 is provided in the right side of the first boom 5 positioned at the opposite side to the left boom cylinder 9 to put the first boom 5 in between. Since the right boom cylinder 10 is similar to the left boom cylinder 9 in regard to the configuration, the operation and the like other than the arrangement position, the identical reference numerals are referred to as components in the right boom cylinder 10, and the explanation is omitted. That is, the right boom cylinder 10 has a bottom-side mounting portion 10C of the tube 10A that is rotatably mounted to a cylinder mounting portion 15C2 of a right vertical plate 15C forming the revolving frame 15 by using a connecting pin 10D, and a rod-side mounting portion 10E of a rod 10B is mounted to the tip end mounting portion 5C of the first boom 5 to be coaxial with and rotatable to the base end 6A of the second boom 6 and the left boom cylinder 9 by the connecting pin 5D. Here, the bottom-side mounting portion 10C (connecting pin 10D) of the right boom cylinder 10 is arranged in a position lower by a height dimension H than a first boom mounting portion 15C1 of the right vertical plate 15C, and in a position ahead thereof by the length dimension L as similar to the left boom cylinder 9.

The left and right boom cylinders 9 and 10 respectively compress and expand the rods 9B and 10B to the tubes 9A and 10A to lift and tilt the first boom 5 and the second boom 6 to the revolving frame 15. Here, in a case of traveling the hydraulic excavator 1, for suppressing a projection dimension of the working mechanism 4 to the front side, the rods 9B and 10B of the boom cylinders 9 and 10 respectively are expanded to the maximum to rotate the tip end of the first boom 5 to the rear side for being arranged to be in a position of the traveling stance (position shown in FIG. 1 to FIG. 3).

In the traveling stance of the first boom 5, the respective boom cylinders 9 and 10 positioned in the front side are inclined to the rear side together with the first boom 5. Specifically, as shown in FIG. 3, when a vertical line at the positions of the connecting pins 9D and 10D of the respective boom cylinders 9 and 10 are indicated at A-A, an axis line O-O of the respective boom cylinders 9 and 10 at the traveling stance is inclined to the rear side by a tilting angle $\alpha$ to the vertical line A-A. In the traveling stance, the left boom cylinder 9 at a side of a cab 16 is arranged ahead of the first boom 5 and the bottom portion of the positioning cylinder 11 to be described later, and a front end 9A1 of the tube 9A which is the front end of the left boom cylinder 9 is in a limit position of a range of vision in the right side when an operator seated on an operator's seat 17 looks at the right side.

The positioning cylinder 11 is provided between the first boom 5 and the second boom 6 to be positioned at a front side of the first boom 5. The positioning cylinder 11 performs a telescopic operation to adjust a folding angle of the second boom 6 to the first boom 5. Here, the positioning cylinder 11 is configured of a cylindrical tube 11A, a piston (not shown) slidably provided in the tube 11A, and a rod 11B a base end side of which is connected to the piston and a tip end side of which telescopically projects from the tube 11A. In the positioning cylinder 11, a lower end (bottom portion) of the tube 11A is rotatably mounted to the cylinder bracket 5E provided in the first boom 5, and a top end (tip end) of the rod 11B is rotatably mounted to the cylinder bracket 6D provided in the second boom 6.

The positioning cylinder 11 expands and compresses the rod 11B to the tube 11A to rotate the second boom 6 to the first boom 5 in the upper-lower direction. Here, in the traveling stance of the working mechanism 4, the rod 11B of the positioning cylinder 11 is compressed to the maximum to rotate the tip end of the second boom 6 to the lower side (position shown in FIG. 1 to FIG. 3).

The arm cylinder 12 is provided between the second boom 6 and the arm 7 (refer to FIG. 1 and FIG. 2). A base end (tube side) of the arm cylinder 12 is rotatably connected to the cylinder bracket 6E of the second boom 6, and a tip end (rod side) of the arm cylinder 12 is rotatably connected to the cylinder bracket 7A of the arm 7. As a result, the arm cylinder 12 compresses and expands, thereby making it possible to rotate the arm 7 at the tip end of the second boom 6 in the upper-lower direction.

The bucket cylinder 13 is provided between the arm 7 and the bucket 8. A base end of the bucket cylinder 13 is rotatably connected to the cylinder bracket 7B of the arm 7, and a tip end of the bucket cylinder 13 is connected to the bucket 8 through a bucket link 14. Therefore, the bucket cylinder 13 compresses and expands, thereby making it possible to rotate the arm bucket 8 at the tip end of the arm 7 in the upper-lower direction.

Next, the configuration of the upper revolving structure 3 will be described. That is, the upper revolving structure 3 is configured of the revolving frame 15, the cab 16, the operator's seat 17, an engine 18, a rear housing cover 20, a right front housing cover 23, and the like, which will be described later.

The revolving frame 15 forms a support structure of the upper revolving structure 3, and the revolving frame 15 is provided with a bottom plate 15A, and a left vertical plate 15B and a right vertical plate 15C that are provided upright on the bottom plate 15A to extend in the front-rear direction. A cab frame portion 15D is provided in the left side of the left vertical plate 15B, and a tank frame portion 15E is provided in the right side of the right vertical plate 15C.

Here, first boom mounting portions 15B1 and 15C1 to which the foot portion 5A of the first boom 5 is rotatably mounted are provided in a front side of the left and right vertical plates 15B and 15C, and cylinder mounting portions 15B2 and 15C2 to which the bottom-side mounting portions 9C and 10C of the boom cylinders 9 and 10 are rotatably mounted are provided in a front end of the left and right vertical plates 15B and 15C. On the other hand, the engine 18 and a counterweight 19 to be described later are provided in a rear side of the left and right vertical plates 15B and 15C.

Further, the cab 16 to be described later is mounted in a front side of the left cab frame portion 15D. An operating oil tank 21, a fuel tank 22, the right front housing cover 23, and the like, which will be described later, are provided in the right tank frame portion 15E.

The cab 16 is mounted in a front portion of the cab frame portion 15D in the revolving frame 15 which is in the left side of the working mechanism 4. The cab 16 forms a residence space on which an operator boards, and the operator's seat 17 (illustrated in a dotted line in FIG. 1) on which the operator is seated is provided inside the cab 16. Therefore the operator can perform a traveling operation and a working operation while making visual contact in the front direction, the side direction or the like in a state of being seated on the operator's seat 17.

Here, an eye line position EP of the operator seated on the operator's seat 17 is positioned ahead of the head rest of the operator's seat 17 substantially in the center of the cab 16 in the right-left direction. The eye line position EP is not unchangeable. For example, in a case of confirming safety in the left-right direction at traveling or in a case of performing an excavating operation of a deep hole at working, the eye line position EP moves in the front direction or the side direction. On the other hand, in a case where the operator adjusts a position of the operator's seat 17 corresponding to the physical size of the operator, the eye line position EP moves in the front-rear direction or in the upper-lower direction. That is, the eye line position EP shown in each figure shows a reference example in a case where an operator with an averaging physical size is seated on the operator's seat 17.

The engine 18 (illustrated in a dotted line in FIG. 1) is mounted in the rear side of the revolving frame 15, and the engine 18 is mounted in a horizontal state to extend in the left-right direction. On the other hand, the counterweight 19 is mounted to the rear end of the revolving frame 15 to be positioned in back of the engine 18. It should be noted that the engine 18 is a representative example of a prime mover, and an electric motor is used in an electric construction machine.

The rear housing cover 20 is provided on the revolving frame 15 to cover the engine 18. The rear housing cover 20 is configured of a left side cover portion 20A for covering the left side of the engine 18, aright side cover portion 20B for covering the right side of the engine 18, and a top surface cover portion 20C provided across a top portion of the respective side cover portions 20A and 20B to cover the top side of the engine 18. Here, since the rear housing cover 20 serves to cover the engine 18 that is the largest component as the mounting equipment, the position of the top surface cover portion 20C is set to a high position.

The operating oil tank 21 is mounted in the tank frame portion 15E of the revolving frame 15 to be positioned in front of the engine 18. The operating oil tank 21 is formed as a closed vessel in a rectangular parallelepiped shape, and reserves therein operating oil that is supplied to various actuators.

The fuel tank 22 is mounted on the tank frame portion 15E to be positioned in front of the operating oil tank 21. The fuel tank 22 is formed as a closed vessel in a rectangular parallelepiped shape, and serves to reserve therein fuel that is supplied to the engine 18.

Next, the right front housing cover 23 according to the present embodiment that is provided in the upper revolving structure 3 will be explained.

Figure 4:
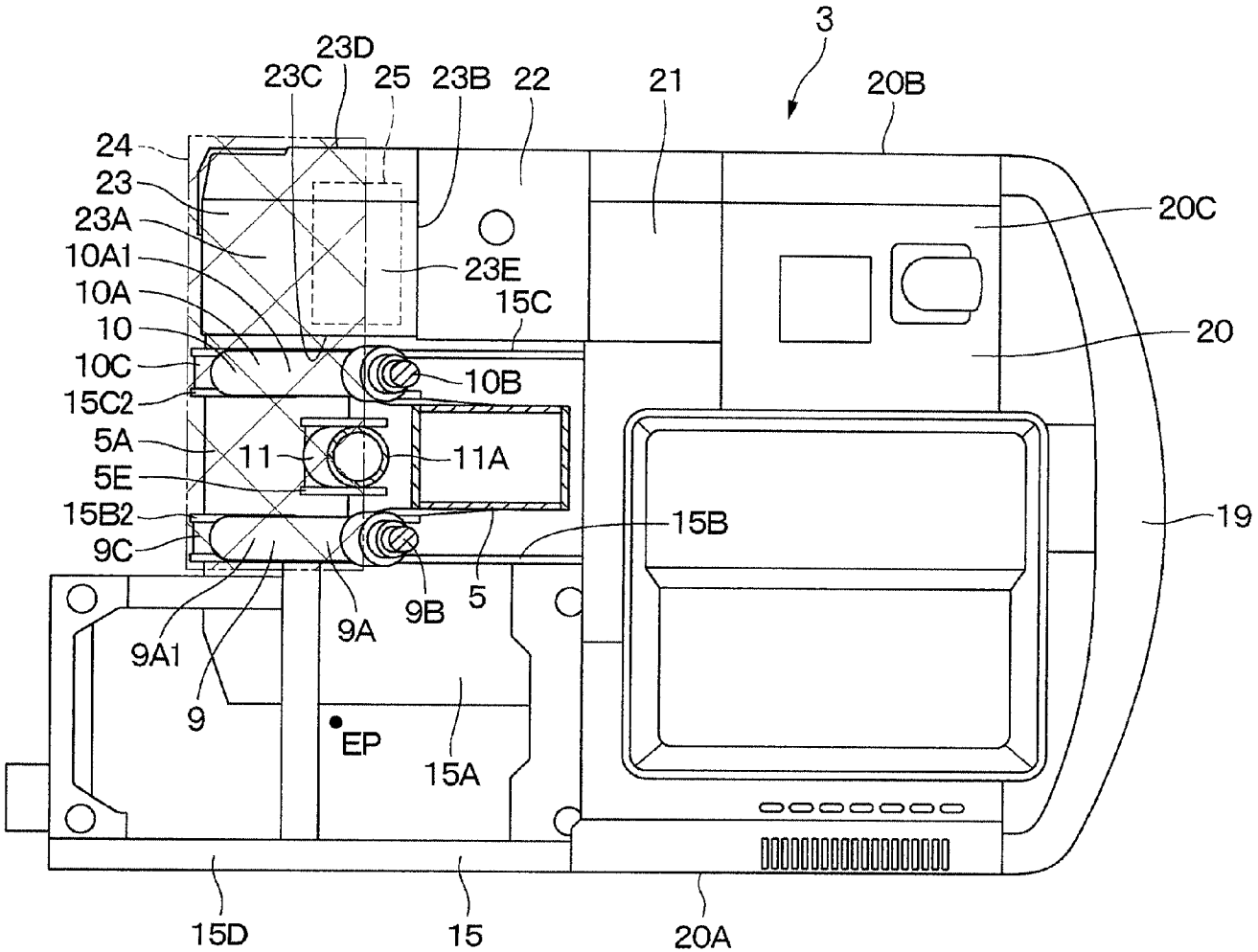
FIG. 4 is a transverse section shown by enlarging the upper revolving structure and the working mechanism as viewed in the direction of arrows VI-VI in FIG. 3 in a state where the cab is removed.
Figure 5:
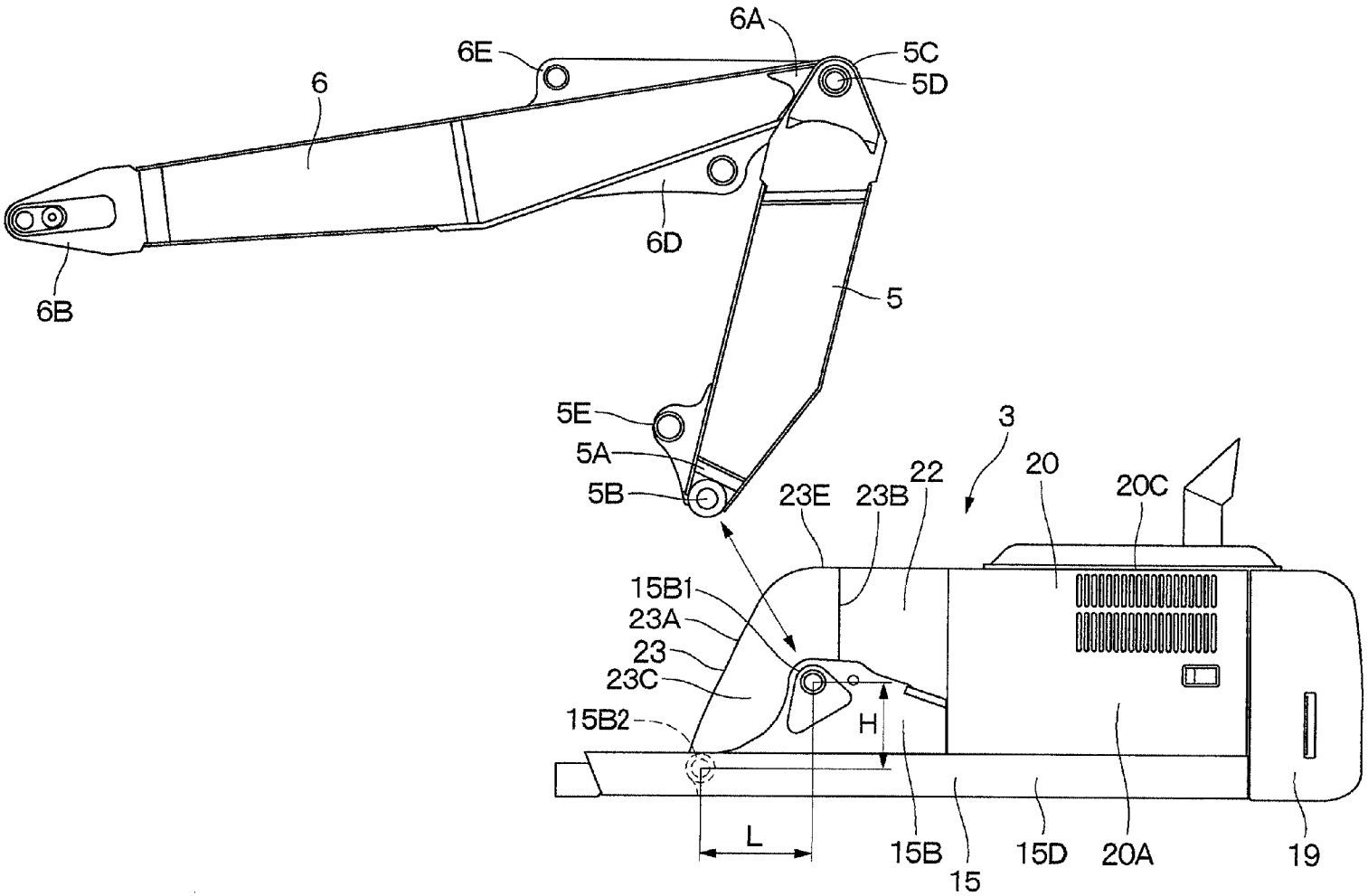
FIG. 5 is an exploded front view showing the upper revolving structure and the boom of the working mechanism in a state where the cab is removed.
Figure 6:
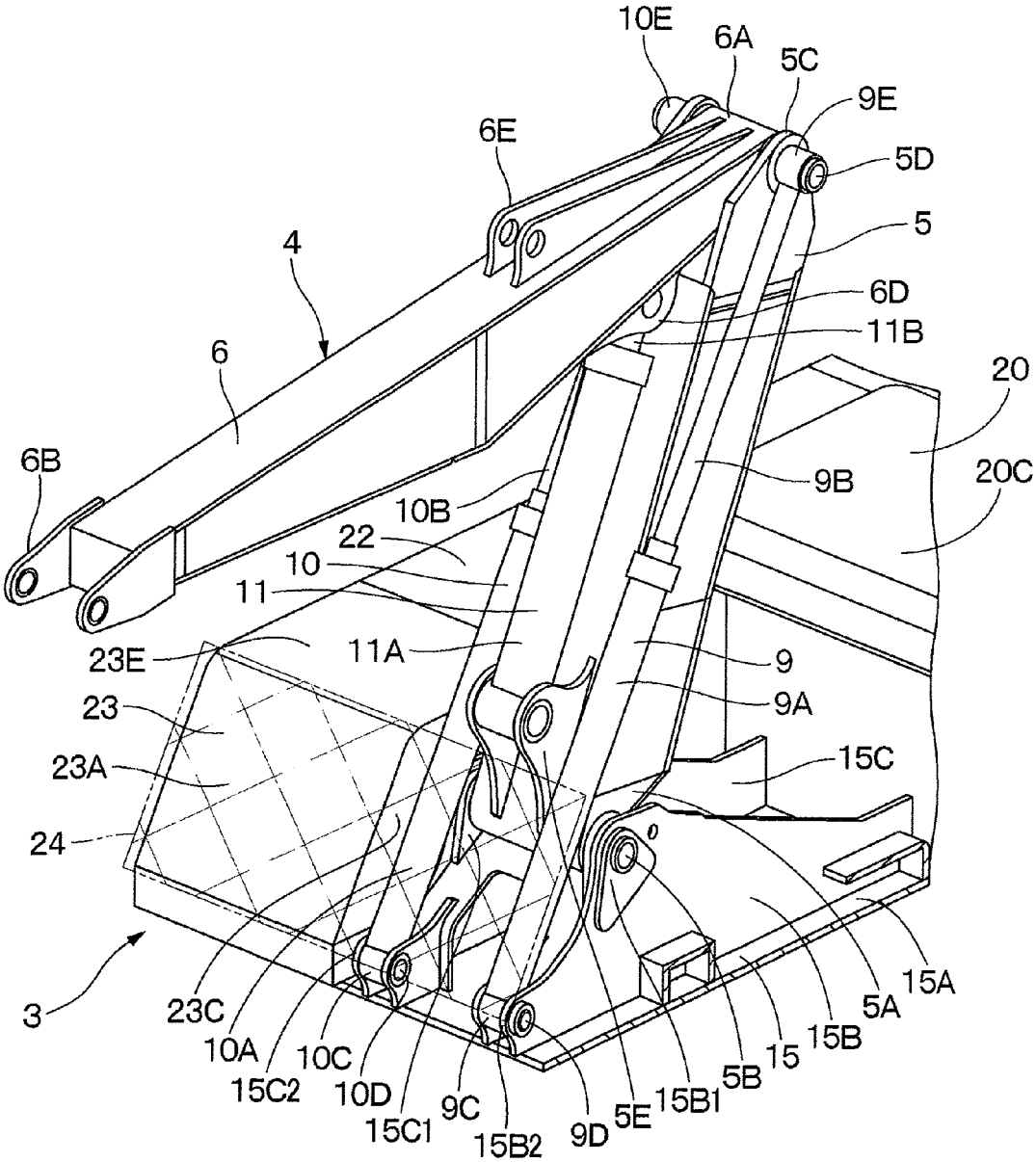
FIG. 6 is a partial perspective view of the upper revolving structure, the boom of the working mechanism, a boom cylinder, a positioning cylinder and the like as viewed from an oblique front side in a state where the cab is removed.

The right front housing cover 23 is provided in the right side of the first boom 5 forming the working mechanism 4, that is, in the front portion of the tank frame portion 15E in the revolving frame 15 in front of the fuel tank 22. As shown in FIG. 2 to FIG. 4, the right front housing cover 23 is configured as a box-shaped body by a rectangular front surface plate 23A positioned in the foremost portion, a rectangular rear surface plate 23B facing the front surface of the fuel tank 22, a trapezoidal left surface plate 23C arranged in an inside of the left-right direction which is a side of the first boom 5, a trapezoidal right surface plate 23D arranged in an outside of the left-right direction, and a rectangular top surface plate 23E for closing the top side. Therefore the right front housing cover 23 can accommodate a control valve device 25, a tool and a grease gun (any of them is not illustrated), and the like therein, which will be described later.

Here, in the traveling stance in which the axis line O-O of each of the left and right boom cylinders 9 and 10 is inclined to the rear side at a tilting angle α, an oblique line in parallel with the axis line O-O of each of the boom cylinders 9 and 10 in a position of each of the front ends 9A1 and 10A1 of the tubes 9A and 10A is indicated at B-B. In this case, a plane extending in the left-right direction on the positions of the oblique lines B-B along the front ends 9A1 and 10A1 of the tubes 9A and 10A is defined as an inclined plane 24 (illustrated as a meshing plane in FIG. 4 and FIG. 6).

That is, the front surface plate 23A of the right front housing cover 23 is arranged in a position of lining with the front ends 9A1 and 10A1 of the tubes 9A and 10A in the respective boom cylinders 9 and 10 in the left-right direction that are at the traveling stance. Specifically, the front surface plate 23A of the right front housing cover 23 is formed to be substantially flush with the inclined plane 24 formed at a tilting angle α in the positions of the front ends 9A1 and 10A1 of the respective tubes 9A and 10A. That is, the respective boom cylinders 9 and 10, and the inclined plane 24 are arranged at the substantially same tilting angle α and on the same plane. It should be noted that the same tilting angle does not mean the same angle literally, but also in a case where there is a slightly angular difference within an allowance range on a design between the tilting angle of the front surface plate 23A of the right front housing cover 23 and the tilting angle of each of the front ends 9A1 and 10A1 of the boom cylinders 9 and 10, each angle of both can be admitted as the same tilting angle. In addition, also in a case where there is a slightly angular difference therebetween in regard to the same plane, each of them can be admitted as the same plane.

According to this configuration, when the operator seated on the operator's seat 17 in the cab 16 looks at the right side from the eye line position EP, the front surface plate 23A of the right front housing cover 23 can be hidden in the shade of the respective boom cylinders 9 and 10. In addition, in a case of confirming the right side of the hydraulic excavator 1 at traveling thereof, some of operators perform a confirmation operation of the right side by moving the operator's head to the front side. Even if the operator thus hangs out to perform this confirmation operation, since the front surface plate 23A of the right front housing cover 23 is arranged in the position of lining with the front ends 9A1 and 10A1 of the tubes 9A and 10A in the respective boom cylinders 9 and 10 in the left-right direction, that is, in the position of the inclined plane 24, the right front housing cover 23 can be arranged in a position of being invisible from the operator, that is, can be positioned outside of a range of vision in the right side of the operator.

On the other hand, the front surface plate 23A of the right front housing cover 23 can be arranged in the front side to the position of lining with the front ends 9A1 and 10A1 of the tubes 9A and 10A in the respective boom cylinders 9 and 10 in the left-right direction. In this way, the right front housing cover 23 that arranges the front surface plate 23A in the front side to the position (inclined plane 24) of the respective boom cylinders 9 and 10 can extend the front surface plate 23A to the front side while arranging it in the position of not interrupting a range of vision to the right side of the operator.

Further, the right front housing cover 23 is formed to have the height dimension in the upper-lower direction that is the same height dimension with the rear housing cover 20 for covering the large engine 18. As a result, the right front housing cover 23 can be formed to be larger in the upper side and the position of the top surface cover portion 20C can be set to a high position. Therefore the right front housing cover 23 can also enlarge the accommodation space of the inside in the upper-lower direction.

Indicated at 25 is a control valve device (illustrated in a dotted line of FIG. 2 and in FIG. 4) mounted on the tank frame portion 15E of the revolving frame 15 to be positioned within the right front housing cover 23. The control valve device 25 supplies/discharges operating oil pressurized in response to various operations by an operator to/from the respective cylinders 9, 10, 11, 12, 13 and the like in the working mechanism 4. Since a plurality of hoses are connected to individual valve bodies in the control valve device 25, a wide space is required as an installation place of the control valve device 25. However, since the right front housing cover 23 can be formed largely in the front side and the top side for the above-mentioned reason, the control valve device 25 can be accommodated in the right front housing cover 23 with an allowance.

The hydraulic excavator 1 according to the present embodiment has the above-mentioned configuration, and next, an operation of the hydraulic excavator 1 will be explained.

In a case of traveling the hydraulic excavator 1, an operator boards on the cab 16 to be seated on the operator's seat 17, expands the respective boom cylinders 9 and 10 to the maximum to recline the first boom 5 to the rear side, and compresses the positioning cylinder 11 to the maximum to fold the second boom 6 to the lower side. Further, the arm 7 is in a state of being extended to the lower side by the arm cylinder 12, and the bucket 8 is rotated (crowded) to the top side by expanding the bucket cylinder 13. The working mechanism 4 can be set to the compact traveling stance by performing these operations. By operating a steering wheel, a pedal and the like (any thereof is not illustrated) for traveling at this traveling stance, the lower traveling structure 2 can be forwarded or retreated. On the other hand, the operator seated on the operator's seat 17 can perform an excavating operation of earth and sand, and the like by tilting the working mechanism 4.

In this way, according to the present embodiment, the front surface plate 23A of the right front housing cover 23 is formed to be inclined along the tilting angle α of the left and right boom cylinders 9 and 10 at the time the working mechanism 4 takes the traveling stance, and the front surface plate 23A of the right front housing cover 23 can be arranged in the position of lining with the front ends 9A1 and 10A1 of the tubes 9A and 10A forming the respective boom cylinders 9 and 10 in the left-right direction, that is, is arranged in the position of becoming the substantially same plane with the inclined plane 24.

Accordingly, when the operator seated on the operator's seat 17 in the cab 16 looks at the right side, the right front housing cover 23 is in a state of being hidden with the left boom cylinder 9. Therefore the operator can travel the hydraulic excavator 1 in a wide range of vision without interruption of the range of vision by the right front housing cover 23. In addition, in a case of confirming the right side at traveling, some of operators perform a confirmation operation of the right side by moving the operator's head to the front side. Even if this confirmation operation is performed, since the right front housing cover 23 is arranged in a position of lining with the respective boom cylinders 9 and 10 in the left-right direction, that is, in a position of the inclined plane 24 which is the substantially same plane with the front ends 9A1 and 10A1 of the tubes 9A and 10A, the right front housing cover 23 can be removed from a range of vision in the right side of the operator.

On the other hand, since the front surface plate 23A of the right front housing cover 23 can be arranged in the front side to the position of lining with the front ends 9A1 and 10A1 of the respective boom cylinders 9 and 10 in the left-right direction, the right front housing cover 23 can be extended in the front side to the limit range of vision to increase the installation space on the revolving frame 15 including the right front housing cover 23.

As a result, also in a case of ensuring the installation space on the revolving frame 15 including the accommodation space of the right front housing cover 23, when the operator boards on the cab 16 and performs the traveling operation, the range of vision in the right side can be widened. Therefore the operability and the safety at traveling can be improved. Further, since the right front housing cover 23 can largely be formed, the engine 18, the tanks 21 and 22, the control valve device 25 and the like can be easily incorporated on the revolving frame 15 to improve the assembling operability and the like.

On the other hand, the height dimension of the right front housing cover 23 is formed to have the same height dimension with the rear housing cover 20 formed in a large height dimension for covering the engine 18. Accordingly, since the accommodation space within the right front housing cover 23 can largely be formed in the upper-lower direction, a large device and many tools can be accommodated therein.

Further, the bottom-side mounting portions 9C and 10C of the respective boom cylinders 9 and 10 are mounted to the cylinder mounting portions 15B2 and 15C2 that are in a position lower by the height dimension H than the first boom mounting portions 15B1 and 15C1 provided in the respective vertical plates 15B and 15C of the revolving frame 15 and in a position ahead thereof by the length dimension L. On the other hand, the rod-side mounting portions 9E and 10E of the respective boom cylinders 9 and 10 are connected to the tip end mounting portion 5C of the first boom 5 coaxially with the second boom 6. Therefore when the working mechanism 4 takes the traveling stance, the boom cylinders 9 and 10 can largely be inclined to the rear side, and by increasing the tilting angle $\alpha$ at this time, a range of vision in the right side can be widened.

It should be noted that in the above embodiment, a case of accommodating the control valve device 25 within the right front housing cover 23 is explained as an example. However, the present invention is not limited thereto, and the present invention may be applied to the configuration that other components such as tools, tanks and the like are accommodated within the right front housing cover 23, for example.

In the above embodiment, a case where in the respective boom cylinders 9 and 10, the tubes 9A and 10A are arranged in the lower side and the rods 9B and 10B are arranged in the upper side is explained as an example. However, the present invention is not limited thereto, and the present invention may be applied to the configuration that the respective boom cylinders 9 and 10 are used in an inverted state where the tubes 9A and 10A are arranged in the upper side and the rods 9B and 10B are arranged in the lower side, for example. It should be noted that in this case, each lower end of the rods 9B and 10B is mounted to each of the cylinder mounting portions 15B2 and 15C2 as one end in the length direction, and each upper end of the tubes 9A and 10A is mounted to the tip end mounting portion 5C of the first boom 5 as the other end in the length direction.

On the other hand, in the above embodiment, the hydraulic excavator 1 provided with the wheel type lower traveling structure 2 as the construction machine is explained as an example. However, the present invention is not limited thereto, and may be applied to a hydraulic excavator provided with a lower traveling structure of a crawler type, for example.

DESCRIPTION OF REFERENCE NUMERALS

1: Hydraulic excavator (Construction machine)
2: Lower traveling structure
3: Upper revolving structure
4: Working mechanism
5: First boom
5A: Foot portion
5C: Tip end mounting portion
6: Second boom
6A: Base end
6B: Mounting portion
7: Arm
8: Bucket
9: Left boom cylinder
9A, 10A: Tube
9A1, 10A1: Front end
9B, 10B: Rod
9C, 10C: Bottom-side mounting portion
9E, 10E: Rod-side mounting portion
10: Right boom cylinder
11: Positioning cylinder
12: Arm cylinder
13: Bucket cylinder
15: Revolving frame
15A: Bottom plate
15B: Left vertical plate
15B1, 15C1: First boom mounting portion
15B2, 15C2: Cylinder mounting portion
15C: Right vertical plate
16: Cab
17: Operator's seat
18: Engine (Prime mover)
20: Rear housing cover
23: Right front housing cover
23A: Front surface plate
24: Inclined plane
O-O: Axis line of a boom cylinder
$\alpha$: Tilting angle of a boom cylinder
B-B: Oblique line along a front end of a boom cylinder
H: Height dimension
L: Length dimension

The invention claimed is:

1. A wheel type hydraulic excavator comprising:

a vehicle body;

a working mechanism tiltably disposed in an intermediate position in a left-right direction at a front side of said vehicle body;

a cab disposed at a front portion of said vehicle body and on a left side of said working mechanism, and where said cab includes an operator's seat for an operator to be seated on; and a right front housing cover disposed at the front portion of said vehicle body and on a right side of said working mechanism, wherein said working mechanism includes:

a first boom with a base end rotatably connected to said vehicle body;

a second boom rotatably connected to a tip end of said first boom;

a boom cylinder of which a first end in a length direction is connected to a cylinder mounting portion of said vehicle body in a position ahead of said base end of said first boom and a second end in the length direction is connected to a side of said tip end of said first boom to tilt said first boom relative to said vehicle body; and a positioning cylinder disposed between said first boom and said second boom at a front surface side of said first boom to adjust a folding angle of said second boom to said first boom, wherein said working mechanism is positioned in a traveling stance when said boom cylinder is expanded to rotate said tip end of said first boom towards a rear side and said positioning cylinder is compressed to rotate a tip end of said second boom towards a lower side;

wherein said working mechanism positioned in said traveling stance includes said boom cylinder inclined towards the rear side at a tilting angle ($\alpha$) in such a manner that said second end is positioned in back of said first end, and wherein said right front housing cover includes a front surface plate of inclined towards the rear side and positioned in an inclined plane extending in the left-right direction along a front end of said boom cylinder when said working mechanism is positioned in said traveling stance.

2. The wheel type hydraulic excavator according to claim 1, wherein said front surface plate inclined towards the rear side at the tilting angle ($\alpha$) and in plane with said front end of said boom cylinder.

3. The wheel type hydraulic excavator according to claim 1, wherein said front surface plate is disposed flush with said inclined plane when said working mechanism is positioned in said traveling stance.

4. The wheel type hydraulic excavator according to claim 1, wherein said vehicle body is provided with a rear housing cover for covering a prime mover mounted at the rear side, and said right front housing cover is disposed at a same height as said rear housing cover.

* * * * *